US006013869A

United States Patent [19]

Hansen

[11] Patent Number: 6,013,869

[45] Date of Patent: Jan. 11, 2000

[54] MUSICAL INSTRUMENT HOLDER

[76] Inventor: Kaj Hansen, 533 Chanticleer, Cherry Hill, N.J. 08003

[21] Appl. No.: 09/245,643

[22] Filed: Feb. 8, 1999

[51] Int. Cl.[7] ..... G10D 7/10

[52] U.S. Cl. ..... 84/387 A; 84/327; 84/453

[58] Field of Search ..... 84/387 A, 327, 84/421, 453

[56] References Cited

U.S. PATENT DOCUMENTS

| | | | |
|---|---|---|---|
| 3,160,050 | 12/1964 | Klein | 84/327 |
| 4,161,131 | 7/1979 | Blayman | 84/453 |
| 4,407,182 | 10/1983 | Biasini | 84/453 |
| 4,529,865 | 7/1985 | Oakes, Jr. | 219/201 |
| 4,738,180 | 4/1988 | McKnight | 84/385 |

*Primary Examiner*—Robert E. Nappi
*Assistant Examiner*—Shih-yung Hsieh
*Attorney, Agent, or Firm*—Henderson & Sturm

[57] ABSTRACT

A musical instrument holder 10 for supportingly receiving a selected one of a class of woodwind instruments 100 wherein the holder 10 includes a base member 20 provided with inner 25 and outer 26 peripheral recesses for supportingly one group of wide-mouthed woodwind instruments 104, 105 and 106 and a vertical support post member 30 operatively associated with the base member 20 and having vertically spaced shoulders 31 and 32 for supporting another group of small-mouthed woodwind instruments 101, 102.

16 Claims, 3 Drawing Sheets

MUSICAL INSTRUMENT HOLDER

BACKGROUND OF THE INVENTION

1. Field of the Invention

The present invention relates to the field of musical instrument supports in general and in particular to a musical instrument holder that can accommodate a wide variety of woodwind instruments.

2. Description of the Related Art

As can be seen by reference to the following U.S. Pat. Nos. 4,738,180; 4,407,182; 4,529,865; and 4,161,131; the prior art is replete with myriad and diverse musical instrument stands.

While all the aforementioned prior art constructions are more than adequate for the basic purpose and function for which they have been specifically designed, they are uniformly deficient with respect to their failure to provide a simple, efficient, and practical musical instrument holder that can accommodate a wide variety of woodwind instruments.

As most musicians are all too painfully aware, a great deal of time, money and effort is devoted to perfecting their skills on their musical instruments and careless handling can irreparably damage these sensitive and costly instruments in which the musicians has made both and emotional and financial investment.

As a consequence of the foregoing situation, there has existed a longstanding need for a new and improved type of musical instrument holder that is specifically designed to support a wide variety of woodwind instruments; and, the provision of such a construction is the stated objective of the present invention.

BRIEF SUMMARY OF THE INVENTION

Briefly stated, the musical instrument holder that forms the basis of the present invention comprises in general a contoured based unit and a contoured vertical support unit which projects upwardly from the contoured base unit and serves as a guide for the larger mouthed woodwind instruments.

As will be explained in greater detail further on in the specification, the vertical support unit comprises a vertical support post member provided with a plurality of stepped shoulders, each of which are dimensionally to receive the bell of a different woodwind instrument; wherein, the uppermost end of the support post member serves as a guide for the bell of the instrument.

In addition, the base unit includes a base member provided with a central core and a plurality of peripheral recesses, all of which are dimensioned to receive the bell of a different sized woodwind instrument.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
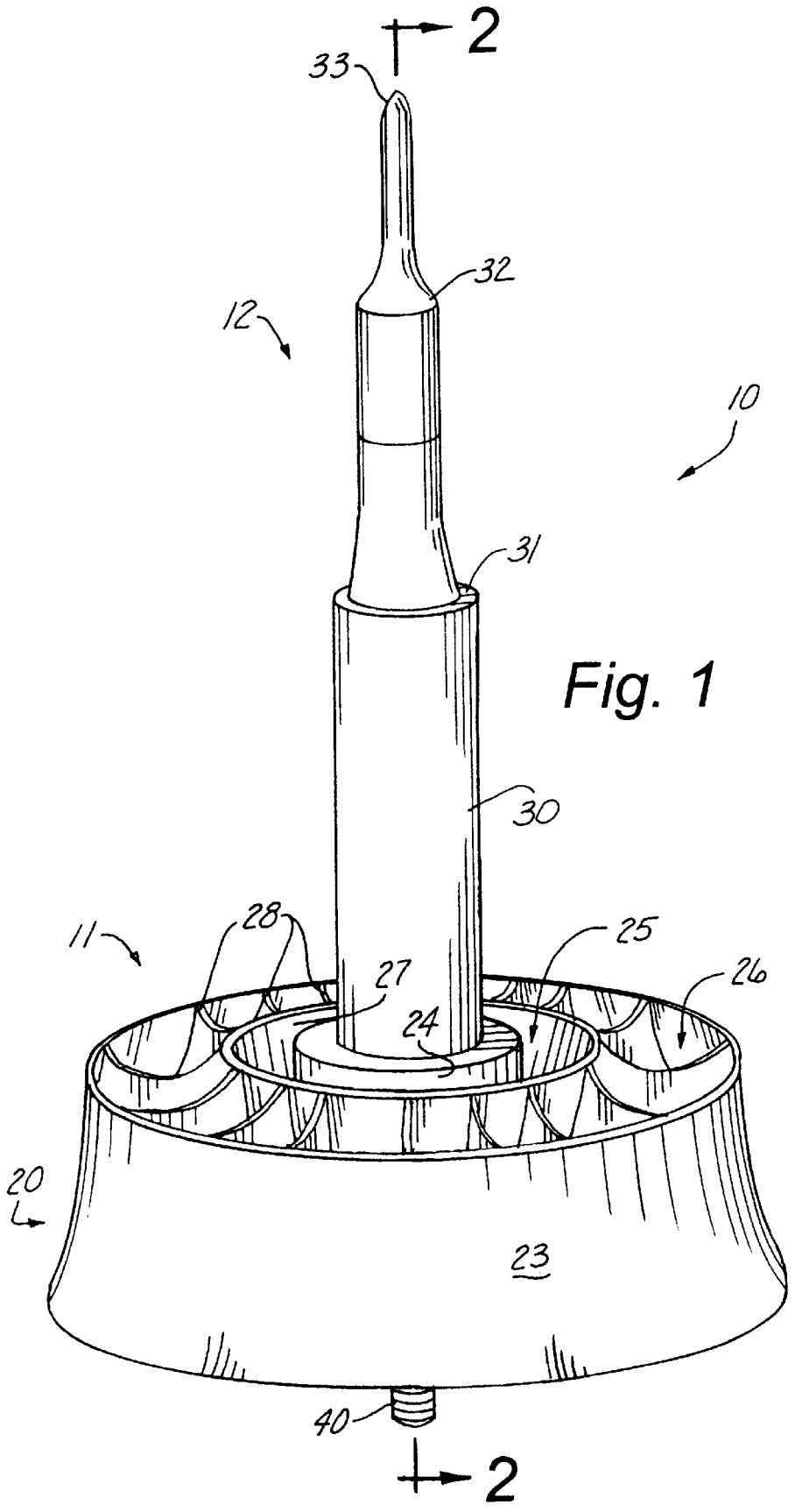
FIG. 1 is a perspective view of the first version of the preferred embodiment.

As can bee seen by references to the drawings, and in particular to FIG. 1, the musical instrument holder that forms the basis of the present invention is designated generally by the reference number 10. The holder 10 comprises in general a base unit 11 and a vertical support unit 12. These units will now be described in seriatim fashion.

Figure 2:
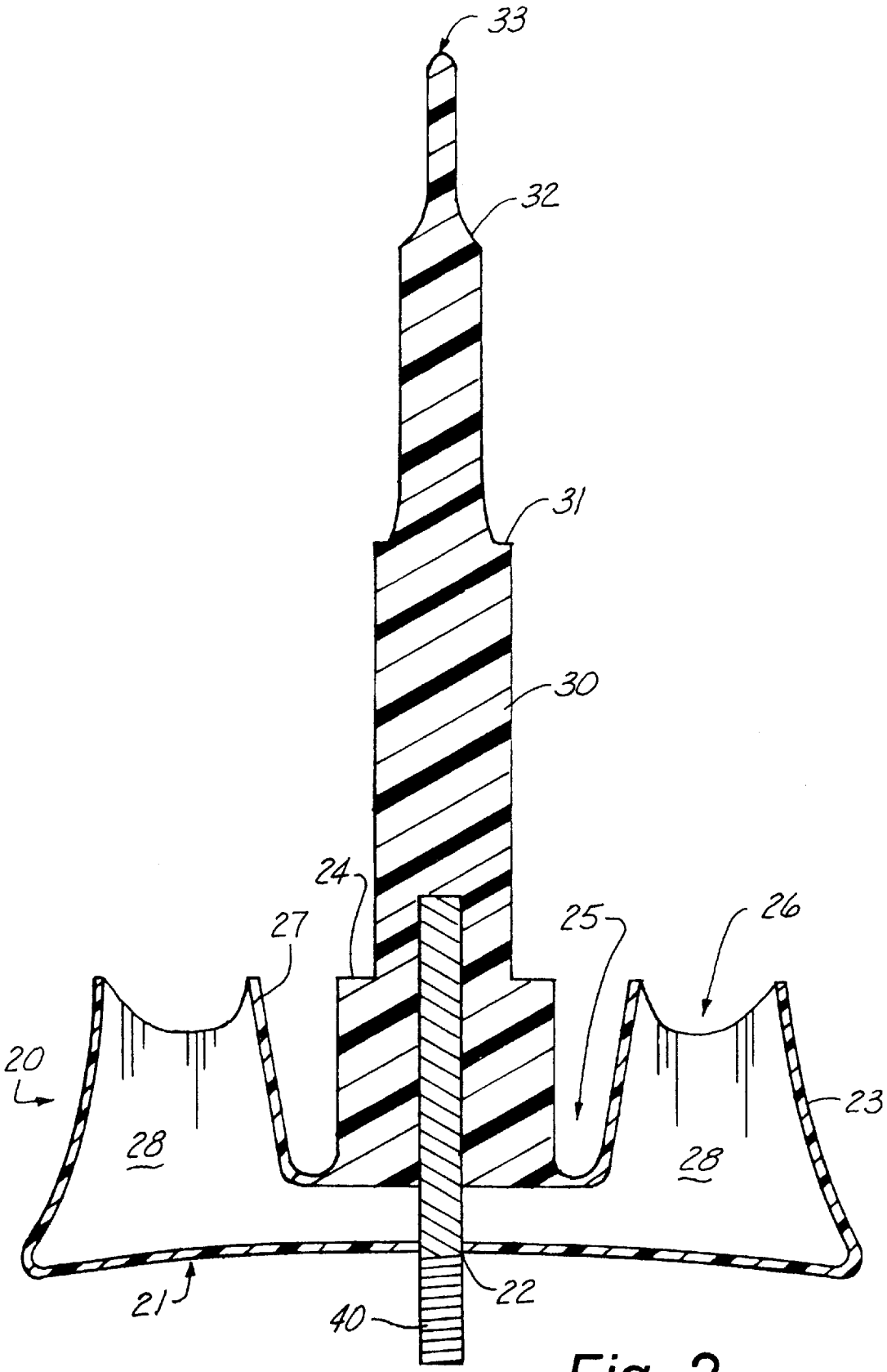
FIG. 2 is a cross-sectional view taken thru line 2—2 of FIG. 1.

As can best be seen by reference to FIGS. 1 and 2, the base unit 11 comprises an enlarged base member 20 having a generally flat bottom 21 provided with a control aperture 22 wherein the sidewalls 23 of the base member 20 are angled upwardly and outwardly relative to the bottom 21 of the base member 20.

Furthermore, the interior of the base member 20 includes a generally cylindrical central core 24 surrounded by a relatively deep inner peripheral recess 25 which in turn is surrounded by a relatively shallow outer peripheral recess 26 wherein the outer walls 27 of the inner peripheral recess 25 are operatively connected to the sidewalls 23 of the base member 20 by a plurality of partition elements 28 having downwardly curved upper ends which define the outer peripheral recess 26.

As can also be seen by reference to FIGS. 1 and 2, the vertical support unit 12 project upwardly from, and may be formed integrally with, the central core 24 of the base member 20; wherein the vertical support unit 12 comprises a vertical support post member 30 having a plurality of inwardly tapered peripheral shoulders 31 and 32 formed at spaced locations along its vertical length; wherein the upper end of the vertical support post 30 terminates in a slender narrow peg element 33 which serves as a guide element for the bell openings in the various woodwind instruments 100 that may be employed in conjunction with this device.

In addition, as can best be seen by reference to FIG. 2 in the first version of the preferred embodiment, the central core 24 of the base member 20 is provided with an elongated aperture which is dimensioned to receive a threaded rod member 40 which passes thru the central aperture 21 in the base member 20 and is adapted to be threadably engaged in a complementary recess (not shown) in a suitable substrate such as a floor or a musical stand to maintain the holder 10 in a vertically upright position.

As can also be seen by reference to FIG. 2, the elongated aperture in the central core 24 of the base member 20 can extend into the lower portion of the vertical support rod member 30 to secure the support rod member 30 to the base member 20 in those instances wherein those members 20 and 30 are not formed integrally with one another.

Figure 3:
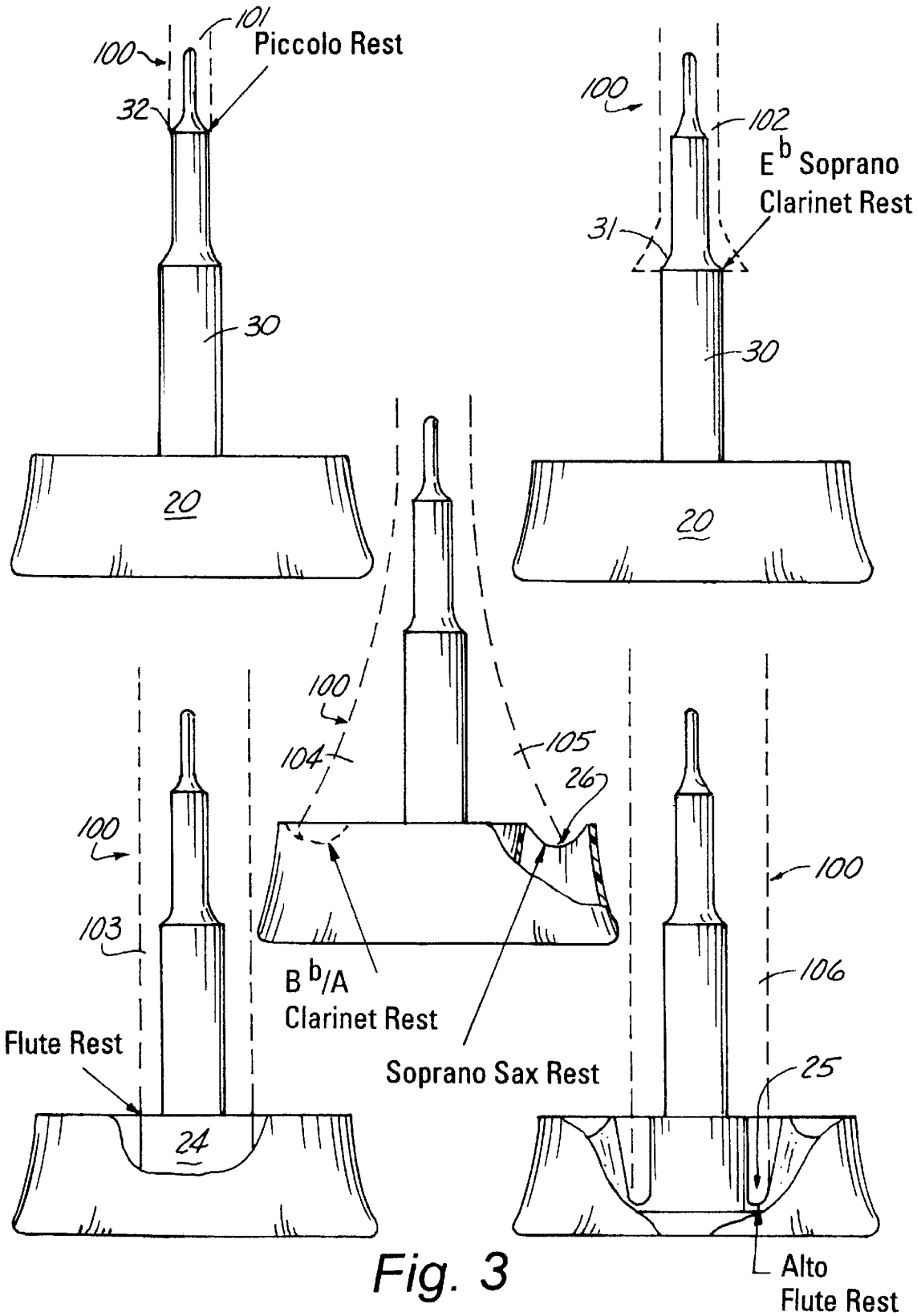
FIG. 3 shows the second version of the preferred embodiment supporting a variety of woodwind instruments.

As can be seen by reference to FIG. 3, the only difference between the first and second versions of the preferred embodiment of this invention is the absence of the threaded rod member 40 in the second version depicted in FIG. 3.

As can also be seen by reference to FIG. 3, the upper shoulder 32 is dimensioned to receive a piccolo 101; the lower shoulder 31 is dimensioned to receive an $E^b$ soprano clarinet 102; the central core 24 is dimensioned to receive a flute 103; the outer peripheral recess 26 is dimensioned to receive either a clarinet 104 or a soprano sax 105; and, the inner recess 25 is dimensioned to receive an alto flute 106.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, mean-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A musical instrument holder for a class of woodwind instruments including a piccolo, a clarinet, a flute, a soprano sax and a flute wherein the holder comprises:

a base unit including an enlarged base member provided with a central core; and, a vertical support unit including an elongated vertical support post member projecting upwardly from the central core of the base member and provided with a plurality of vertically spaced stepped shoulders wherein each of said stepped shoulders is dimensioned to supportingly receive a selected one of said class of woodwind instruments.

2. The holder as in claim 1, wherein said central core has a generally cylindrical configuration and is dimensioned to supportingly receive a selected one of said class of woodwind instruments.

3. The holder as in claim 2, wherein said central core is surrounded by a relatively deep peripheral recess that is dimensioned to supportingly receive a selected one of said class of woodwind instruments.

4. The holder as in claim 2, wherein said central core is surrounded by a relatively shallow peripheral recess that is dimensioned to supportingly receive at least one of said class of woodwind instruments.

5. The holder as in claim 3, wherein said central core is further surrounded by a relatively shallow peripheral recess that is dimensioned to supportingly receive at least one of said class of woodwind instruments.

6. The holder as in claim 5, wherein said relatively shallow peripheral recess comprises an outer peripheral recess and said relatively deep peripheral recess comprises an inner peripheral recess.

7. The holder as in claim 4, wherein said relatively shallow peripheral recess is dimensioned to receive a selected pair of said class of woodwind instruments.

8. The holder as in claim 1, wherein said base member is further provided with a downwardly depending threaded rod member.

9. A musical instrument holder for a class of woodwind instruments including a piccolo, an alto clarinet, a clarinet, a flute, a soprano sax, and a flute wherein the holder comprises:

a base unit including an enlarged base member provided with a central core that is dimensioned to supportingly receive a selected one of said class of woodwind instruments and further having a first peripheral recess surrounding said central core that is dimensioned to receive at least one other selected one of said class of woodwind instruments; and a vertical support unit including an elongated vertical support post member wherein the upper end of the vertical support post member comprises a narrow peg element that serves as a guide for said class of woodwind instruments.

10. The holder as in claim 9, wherein said base member is further provided with a second peripheral recess surrounding said central core, that is dimensioned to receive at least another selected one of said class of woodwind instruments.

11. The holder as in claim 10, wherein said first and second peripheral recesses are disposed adjacent to one another.

12. The holder as in claim 11, wherein at least one of said first and second peripheral recesses is dimensioned to supportingly receive a pair of selected one of said class of woodwind instruments.

13. The holder as in claim 11, wherein at least one of the peripheral recesses defines a relatively deep peripheral recess and the other peripheral recess defines a relatively shallow peripheral recess.

14. The holder as in claim 9, wherein the vertical support post member is provided with at least one stepped shoulder that is dimensioned to supportingly receive a selected one of said class of woodwind instruments.

15. The holder as in claim 9, wherein the vertical support post member is provided with a plurality of stepped shoulders which are each dimensioned to supportingly receive a selected one of said class of woodwind instruments.

16. The holder as in claim 9, wherein said base member is further provided with a downwardly depending threaded rod member.

* * * * *